US007023404B2

(12) United States Patent
Huang

(10) Patent No.: US 7,023,404 B2
(45) Date of Patent: Apr. 4, 2006

(54) METHOD FOR DRIVING A PLASMA DISPLAY PANEL WITH A PRIMING ELECTRODE AND STRUCTURE THEREFOR

(75) Inventor: Jih-Fon Huang, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 504 days.

(21) Appl. No.: 10/313,363

(22) Filed: Dec. 6, 2002

(65) Prior Publication Data

US 2003/0107533 A1 Jun. 12, 2003

(30) Foreign Application Priority Data

Dec. 7, 2001 (TW) ..... 90130455 A

(51) Int. Cl.
*G09G 3/28* (2006.01)

(52) U.S. Cl. ..... 345/60; 345/66; 345/67; 345/68

(58) Field of Classification Search ..... 345/60–69, 345/74.1–76; 315/165–170; 313/484–493, 313/514–520
See application file for complete search history.

(56) References Cited

U.S. PATENT DOCUMENTS 5,969,478 A * 10/1999 Shino et al. ..... 315/169.4
6,144,348 A * 11/2000 Kanazawa et al. ..... 345/60
6,150,766 A * 11/2000 Shino et al. ..... 315/169.4
6,271,810 B1 * 8/2001 Yoo et al. ..... 345/60
6,476,562 B1 * 11/2002 Yoo et al. ..... 315/169.2
6,605,897 B1 * 8/2003 Yoo ..... 313/582
6,816,135 B1 * 11/2004 Ide et al. ..... 345/60
2001/0026254 A1 * 10/2001 Ide et al. ..... 345/60
2004/0056606 A1 * 3/2004 Ide et al. ..... 315/169.3

FOREIGN PATENT DOCUMENTS

JP 09-245627 9/1997

* cited by examiner

*Primary Examiner*—Vijay Shankar
(74) *Attorney, Agent, or Firm*—Thomas, Kayden, Horstemeyer & Risley

(57) ABSTRACT

A plasma display panel (PDP) having a priming electrode is disclosed. The PDP has a first substrate and a second substrate, wherein the second substrate is opposite to the first substrate. The space between the first substrate and the second substrate is defined as a discharge space and is filled with a discharge gas. A sustaining electrode, a scanning electrode and a priming electrode are all positioned on the first substrate along a first direction. An address electrode is positioned on the second substrate perpendicularly with the first direction. The priming electrode outputs a first priming pulse so as to excite the discharge gas and to produce a plurality of discharge ions.

13 Claims, 9 Drawing Sheets

METHOD FOR DRIVING A PLASMA DISPLAY PANEL WITH A PRIMING ELECTRODE AND STRUCTURE THEREFOR

This application incorporates by reference Taiwan application Serial No. 090130455, filed Dec. 7, 2001.

BACKGROUND OF THE INVENTION

1. Field of the Invention

The invention relates in general to a method for driving a plasma display panel (PDP) and structure thereof, and in particular, to a method for driving a PDP having a priming electrode and structure thereof 2. Description of the Related Art As the fabrication technology of the audio/video (A/V) devices is developing rapidly, higher quality audio and video services are foreseen popular among the users. Take the display device for example. The conventional cathode ray tube (CRT) display cannot provide better audio and video quality than movies, as well as having the disadvantages of large volume, serious radiation issue, and serious image contortion and distortion at the brim region of the screen. The conventional CRT display device certainly cannot satisfy the demands for higher quality audio and video services When the high definition digital television (HDTV) begins to broadcast and the compliant products become more affordable, the CRT displays will be phased out. The plasma display panel (PDP) display, with the advantages of low radiation, low power consumption, and large display area with small volume, will be a very promising HDTV display to replace the CRT display.

FIG. 1 shows a three-dimensional diagram of a plasma display panel (PDP) according to a conventional method. The PDP includes a front substrate 102, a rear substrate 108. A plurality of sustaining electrodes X and scanning electrode Y are arranged alternately and in parallel on the front substrate 102. The sustaining electrode X and the scanning electrode Y are covered with a dielectric layer 104. The dielectric layer is covered with a protective layer 106, which is made of magnesium oxide (MgO), such that the sustaining electrode X and the scanning electrode Y can be protected.

A plurality of address electrodes A are formed on the rear substrate 108, and are orthogonal to the sustaining electrodes X and the scanning electrodes Y respectively. The address electrodes A are covered with a dielectric layer 116. A plurality of ribs 112 are formed on the dielectric layer 116 and are parallel to the address electrodes A. A fluorescence layer 110 is formed between the adjacent ribs 112 and on the sidewall of the ribs 112.

FIG. 2 illustrates the cross-sectional view of a PDP according to a conventional method. All elements of FIG. 1 are shown in FIG. 2 with the same numerical number, except the ribs 112. One sustaining electrode X and one scanning electrode Y composes a pair of driving electrodes on the front substrate 102. One pair of driving electrodes and the corresponding address electrode A on the rear substrate 108 defines a pixel unit 200. The plurality of the sustaining electrodes X, the scanning electrodes Y, and the address electrodes A commonly defines a plurality of pixel units 200, disposed in the form of a rectangle matrix. The area between the pixel units 200 is defined as a dark area 203, as shown in FIG. 2.

A black matrix 212 on the front substrate 102 is positioned between each pair of driving electrodes, and is also in the dark area 203. The black matrix 212 is opaque and is used for blocking the light from the exterior environment so as to increase the contrast of the PDP. The space between the front substrate 102 and the rear substrate 108 is called a discharge space 214 and is filled with the discharge gas mixed with Ne and Xe.

Each pixel unit 200 can be regarded as a capacitive load. The driving circuit provides the alternating current of high frequency for charging each pixel unit 200 through the corresponding sustain electrode X and scan electrode Y The gas in the discharge space 214 is excited, discharged, and then emit UV light. The fluorescence layer 110 absorbs the UV light of specified wavelengths and then emits visible lights.

FIGS. 3A and 3B illustrate the driving sequence for driving a pixel unit in the form of timing chart according to a conventional method. The driving sequence usually includes a reset period T1, an address period T2, and a sustain period T3. In the reset period T1, each pixel unit is reset by respectively applying erase pulses to the corresponding sustain electrode X and the scan electrode Y so that the accumulation of the wall charges for each pixel unit is set to the same. Then, the discharge gas in all pixel units 200 are excited to be discharge ion, and the status of the discharge ions in each pixel unit 200 is reset to the same.

In the address period T2, the image data signals are applied to the pixel units, which are selected to emit lights. In the sustain period T3, light pulses are produced by applying alternating voltages across the sustain electrode X and the scan electrode Y of the selected pixel units by the help of the memory effect of the wall charges.

The reset period T1 further includes three periods: a first reset period T11, a second reset period T12, and a third reset period T13. During the first reset period T11, a first erase pulse $P_{Y1}$ of about 100 μs duration is applied to all the scan electrodes Y so as to remove the wall charges remaining after the last sustain period. During the second reset period T12, a priming pulse $P_{X2}$ is applied to all the sustain electrodes X so as to produce wall charges on the pixel units again and so as to reset the status of the wall charges to be the same. Since the priming pulse $P_{X2}$ provides an instant high voltage across the sustain electrode X and scan electrodes Y, the discharge gas in the discharging space 214 is excited, and becomes the wall charges in each pixel unit. During the third reset period T13, a second erase pulse $P_{Y3}$ of about 100 μs duration is applied to the all scan electrodes Y to remove the redundant wall charges in each pixel unit. Another pulse can be applied to the sustain electrode X in order to remove the wall charges remaining after the last sustain period and the discharge ion remaining in this driving sequence respectively during the first reset period T11 and the third reset period T13.

During the second reset period T12, there are two ways to provide a priming pulse $P_{X2}$. The first one is to provide a priming pulse $P_{X2}$ of high level voltage and of positive polarity to the sustaining electrode X as shown in FIG. 3A. The second one is to provide a priming pulse $P_{X2}$ of positive polarity to the sustaining electrode X and to provide a priming pulse $P_{Y2}$ of negative polarity to the scanning electrode Y, as shown in FIG. 3B. When the priming pulse $P_{X2}$ or the voltage difference between the priming pulse $P_{X2}$ and the priming pulse $P_{Y2}$ becomes larger, the discharge ion in the discharging space 214 is produced by more quantity and the status consistence of the discharge ion for each pixel unit 200 becomes higher.

However, the discharge ion induces the fluorescence layer 110 emitting visible light, which is called as the background glow. The background glow during the reset period T1 will decrease the contrast ratio of the PDP, and lower the quality of the PDP.

SUMMARY OF THE INVENTION

It is therefore an object of the invention to provide a plasma display panel (PDP) with improved the contrast ration, the quality, and the lifetime thereof, wherein a quantity of discharge ions is produced during a reset period.

The present invention discloses a PDP with a priming electrode. The PDP has a first substrate and a second substrate opposite to each other, wherein the space between the first substrate and the second substrate is defined as a discharge space and is filled with a discharge gas. The PDP is divided into a pixel unit and a dark area and comprises a sustaining electrode, a scanning electrode, a priming electrode, and an address electrode. The sustaining electrode and the scanning electrode are positioned in the pixel unit on the first substrate along a first direction, and the address electrode is positioned on the second substrate perpendicularly with the first direction. The priming electrode is positioned in the dark area on the first substrate along the first direction and outputs a first priming pulse so as to excite the discharge gas and to produce a plurality of discharge ions.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

The present invention installs a priming electrode in the dark area so as to excite the discharge gas and to produce the discharge ion by providing a priming pulse in the reset period.

Figure 1:
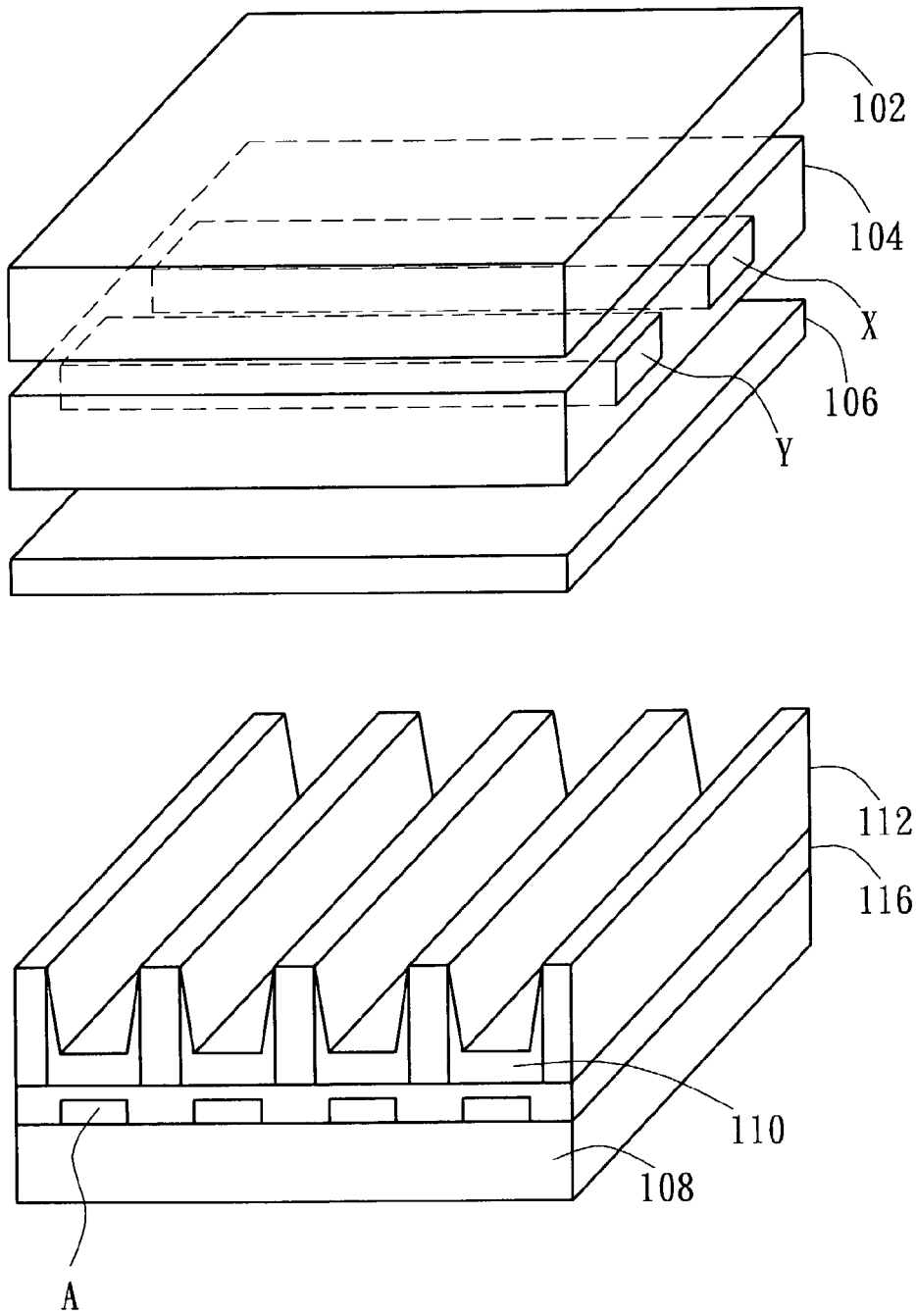
FIG. 1 (PRIOR ART)
FIG. 1 (Prior Art) shows a three-dimensional diagram of a plasma display panel (PDP) according to a conventional method.
Figure 2:
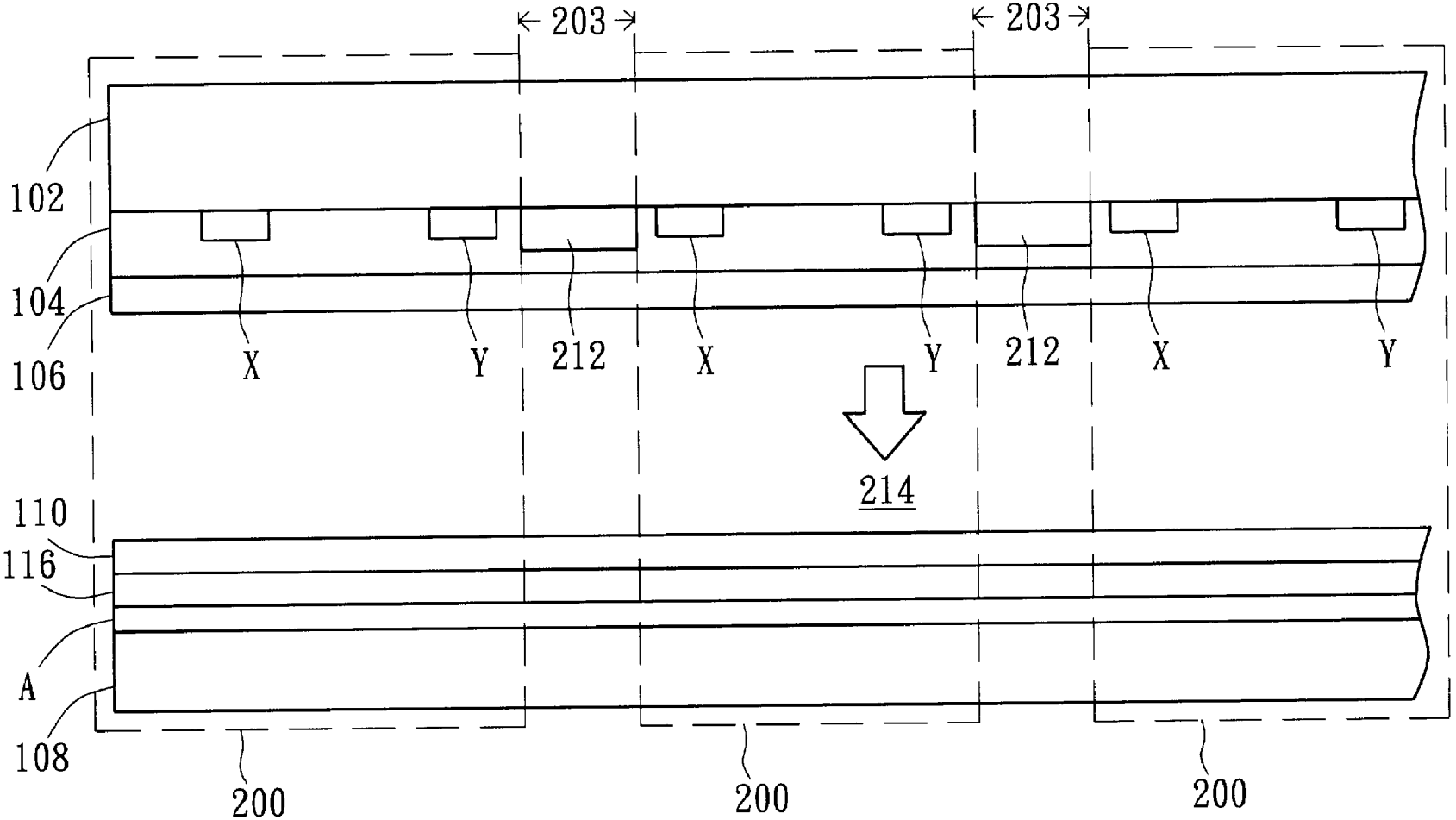
FIG. 2 (PRIOR ART)
FIG. 2 (Prior Art) illustrates the cross-sectional view of a PDP according to a conventional method.
Figure 4:
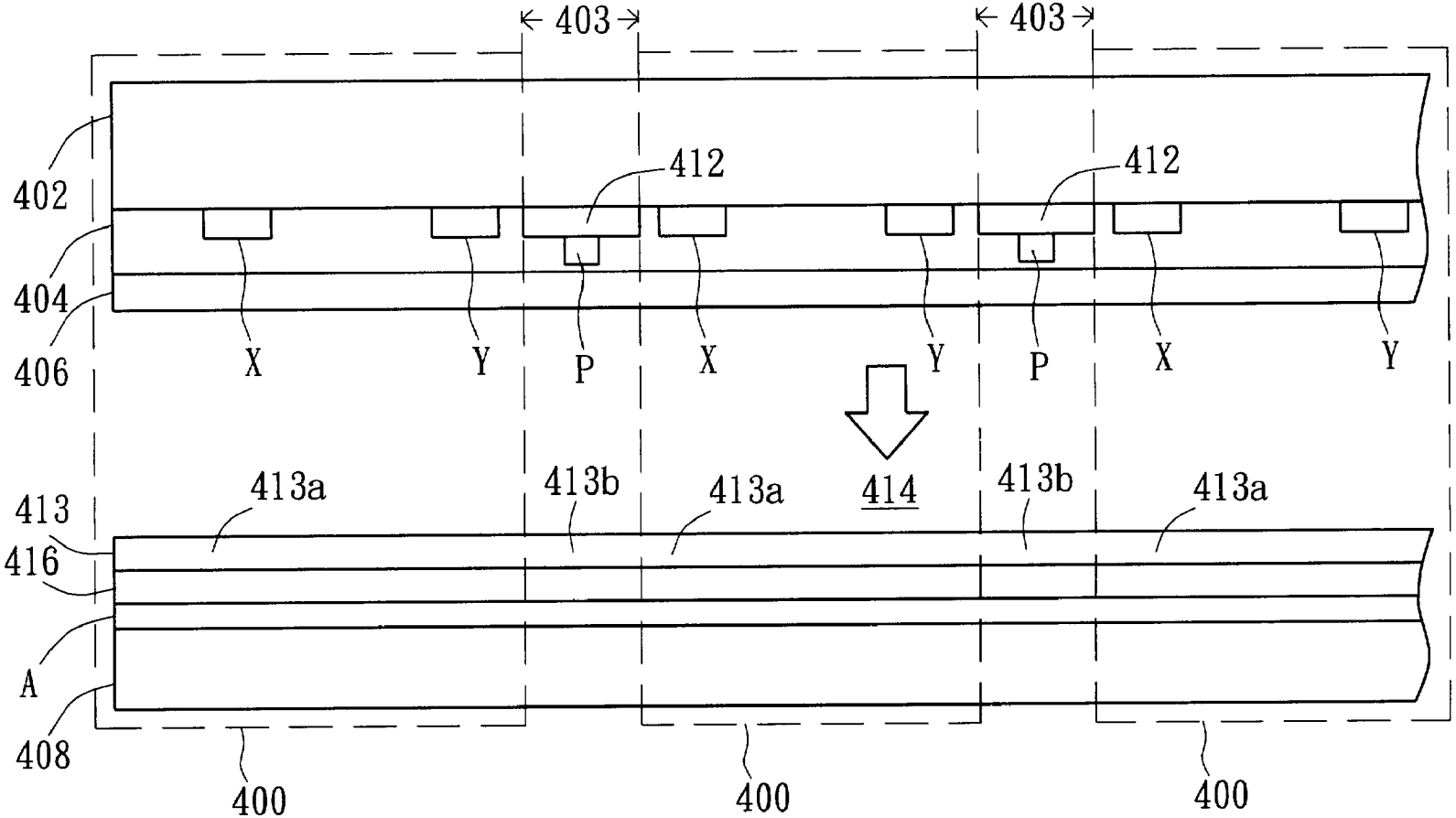
FIG. 4 illustrates the cross-sectional view of a PDP according to one embodiment of the present invention.

FIG. 4 illustrates the cross-sectional view of a plasma display panel (PDP) according to one embodiment of the present invention. The PDP has a plurality of pixel units 400, and dark areas 403 are positioned between each pixel units 400. Comparing with the PDP of FIG. 2, the PDP of FIG. 4 has a priming electrode P in the black matrix 412, or in the dark area 403, on the front substrate 402. The priming electrode P outputs a priming pulse during the reset period as so to excite the discharge gas and to produce the discharge ion.

Figure 5A:
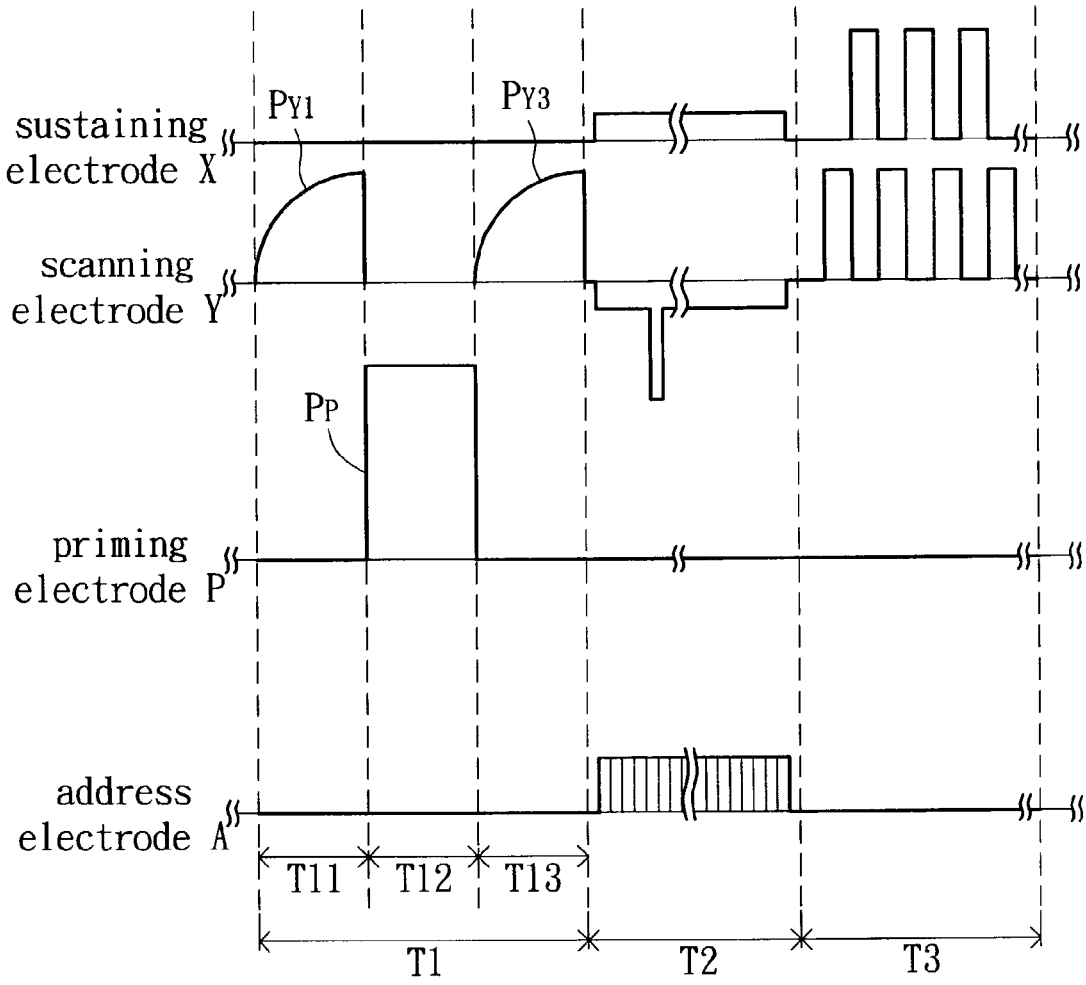
FIG. 5A illustrates the driving sequence for driving a pixel unit in the form of timing chart according to one embodiment of the present invention.

FIG. 5A illustrates the driving sequence for driving a pixel unit 400 in the form of timing chart according to one embodiment of the present invention. The driving sequence usually includes a reset period T1, an address period T2, and a sustain period T3. The reset period T1 further includes three periods: a first reset period T11, a second reset period T12, and a third reset period T13.

During the first reset period T11, an erase pulse $P_{Y1}$ of about 100 μs duration is applied to all the scan electrodes Y so as to remove the wall charges remaining after the last sustain period by the voltage difference between the scan electrode Y and the sustain electrode X. During the second reset period T12, a priming pulse $P_P$ is applied to all the priming electrodes P so as to produce wall charges in the discharging space 414 by the voltage difference between the priming electrode P and the address electrode. The voltage of the priming pulse $P_P$ is larger than that of the erase pulse $P_{Y1}$. During the third reset period T13, a erase pulse $P_{Y3}$ of about 100 μs duration is applied to the all scan electrodes Y to remove the redundant wall charges in each pixel unit 400 by the voltage difference between the scanning electrode and the sustaining electrode. The erase pulse $P_{Y1}$ and the erase pulse $P_{Y3}$ can be positive or negative polarity, as well as the priming pulse $P_P$.

The priming electrode P of the present invention is only used for applying priming pulse during the second reset period T12. Since the priming electrode P is positioned in the dark area 403, the produced discharge ion is also concentrated near the dark area 403. The visible light from the fluorescence layer 413*b* is blocked by the black matrix 412, and the background glow received by the user becomes less. Thus, the contrast ratio of the PDP is improved, as well as the quality thereof. Moreover, the UV light emitted from the discharge ion principally illuminates the fluorescence layer 413*b* in the dark area 403, but not the fluorescence layer 413*a* in the pixel unit 400. Thus, the lifetime of the fluorescence layer 413*a* in the pixel unit 400 is increased, as well as the fluorescence layer 413.

Figure 3A:
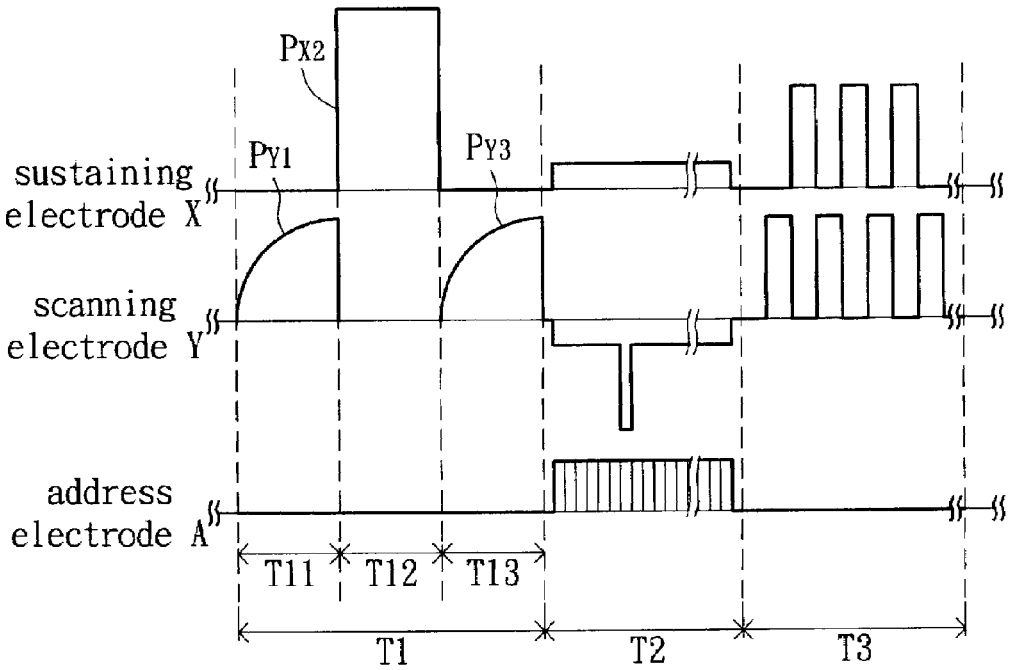
FIG. 3A (PRIOR ART)
FIGS. 3A and 3B (Prior Art) illustrate the driving sequence for driving a pixel unit in the form of timing chart according to a conventional method.
Figure 3B:
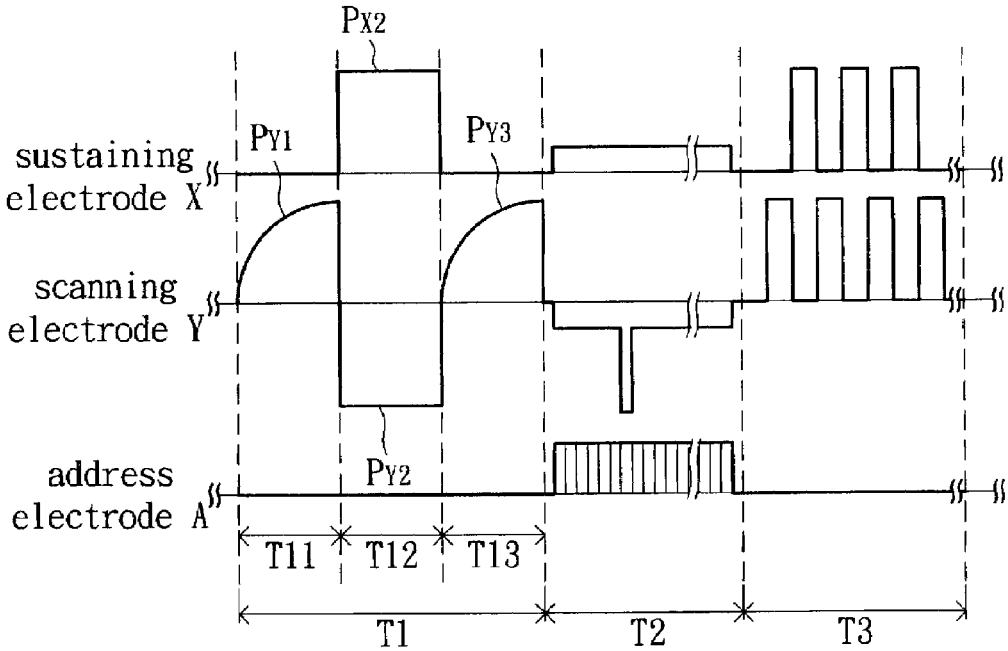
FIG. 3B (PRIOR ART)

In FIG. 5A, the priming electrode P is used for applying priming pulse during the second reset period T12. The sustaining electrode X is used only for applying sustain pulse in the sustain period T3, wherein the sustain pulse is interchanged with the scan pulse applied from the scanning electrode Y. No use of the sustaining electrode X and the scanning electrode Y in the second reset period T12 can simplify the driving sequence, as well as the design of driving circuits respectively for the sustaining electrode X, the scanning electrode Y, and the priming electrode P. Moreover, the sustaining electrode X of FIG. 5A provides a smaller voltage than that of FIG. 3A and FIG. 3B, such that the switch for controlling the sustaining electrode, usually being a MOSFET, is less subject to power consumption.

Figure 5B:
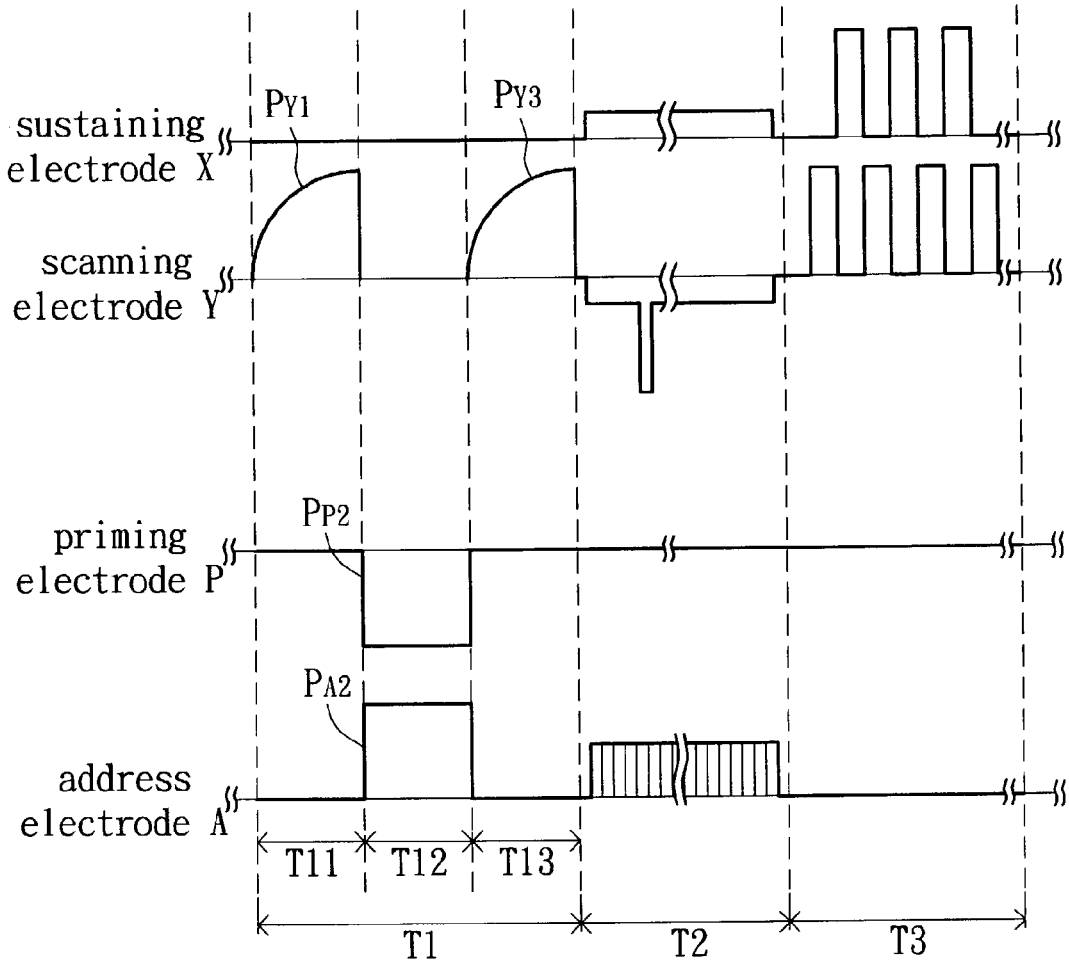
FIG. 5B illustrates the driving sequence for driving a pixel unit in the form of timing chart according another embodiment of the present invention.

FIG. 5B illustrates the driving sequence for driving a pixel unit 400 in the form of timing chart according another embodiment of the present invention. Compared with FIG. 5A, FIG. 5B has a priming pulse $P_{P2}$ and another priming pulse $P_{A2}$, respectively provided by the priming electrode P and the address electrode A, in the second reset period T12 so as to excite the gas in the discharging space 414 and to produce the discharge ion. The priming pulse $P_{P2}$ and another priming pulse $P_{A2}$ are respectively positive and negative in polarity, or vise versa. The different polarity between the priming pulse $P_{P2}$ and another priming pulse $P_{A2}$ can decrease the voltage level of the priming pulse $P_{P2}$, compared with the priming pulse $P_P$ of FIG. 5A. Such that the power consumption caused by the priming pulse $P_{P2}$ can be decreased.

Figure 6A:
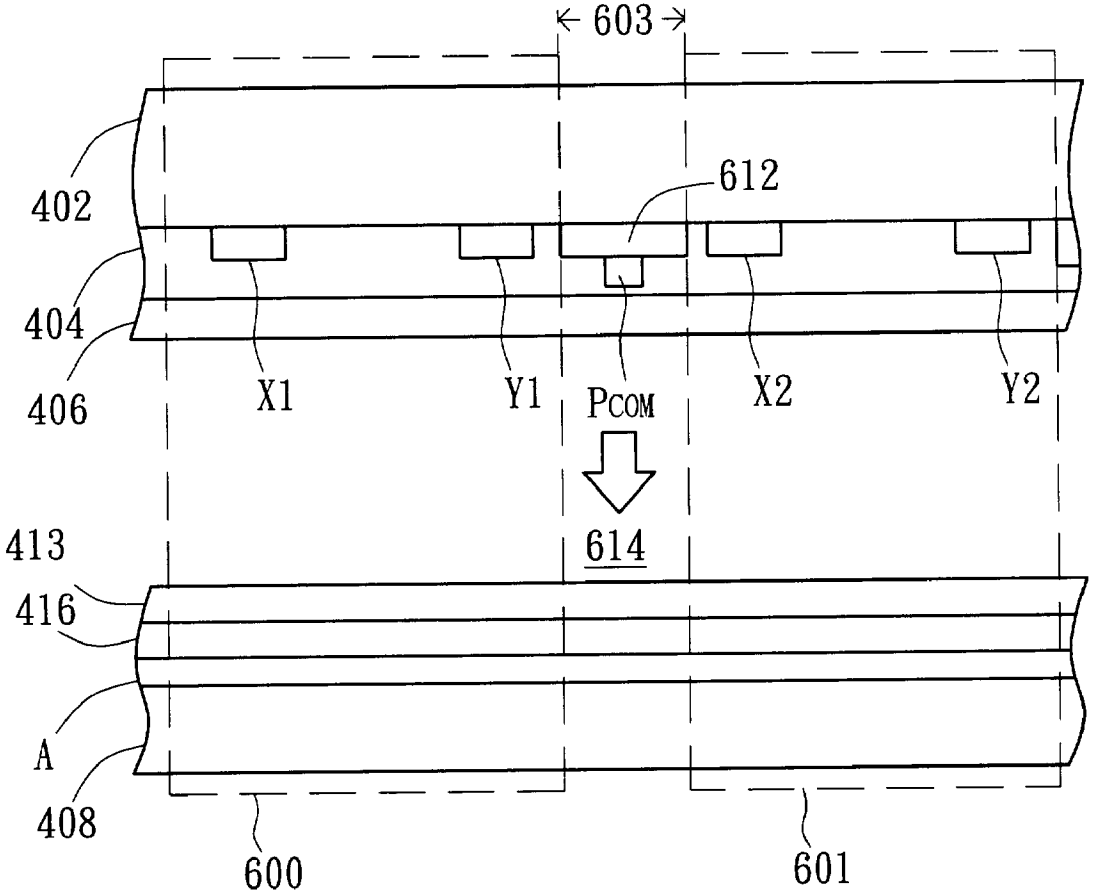
FIG. 6A illustrates the cross-sectional view of a PDP according to another embodiment of the present invention.

FIG. 6A illustrates the cross-sectional view of a plasma display panel (PDP) according to another embodiment of the present invention. Compared with FIG. 4, FIG. 6A provides one common priming electrode $P_{COM}$ for each pair of adjacent pixel units 600, 601. When the common priming electrode $P_{COM}$ is used for applying the priming electrode $P_P$ of the driving sequence in FIG. 5A, the gas both in the pixel units 600 and 601 will be excited and the discharge ion used for illuminating the pixel units 600 and 601 will be produced. When the priming pulses $P_{P2}$, $P_{A2}$ with different polarities are respectively applied from the common priming electrode $P_{COM}$ and address electrode A, the gas both in the pixel units 600 and 601 will be excited and the discharge ion used for illuminating the pixel units 600 and 601 will be produced.

Figure 6B:
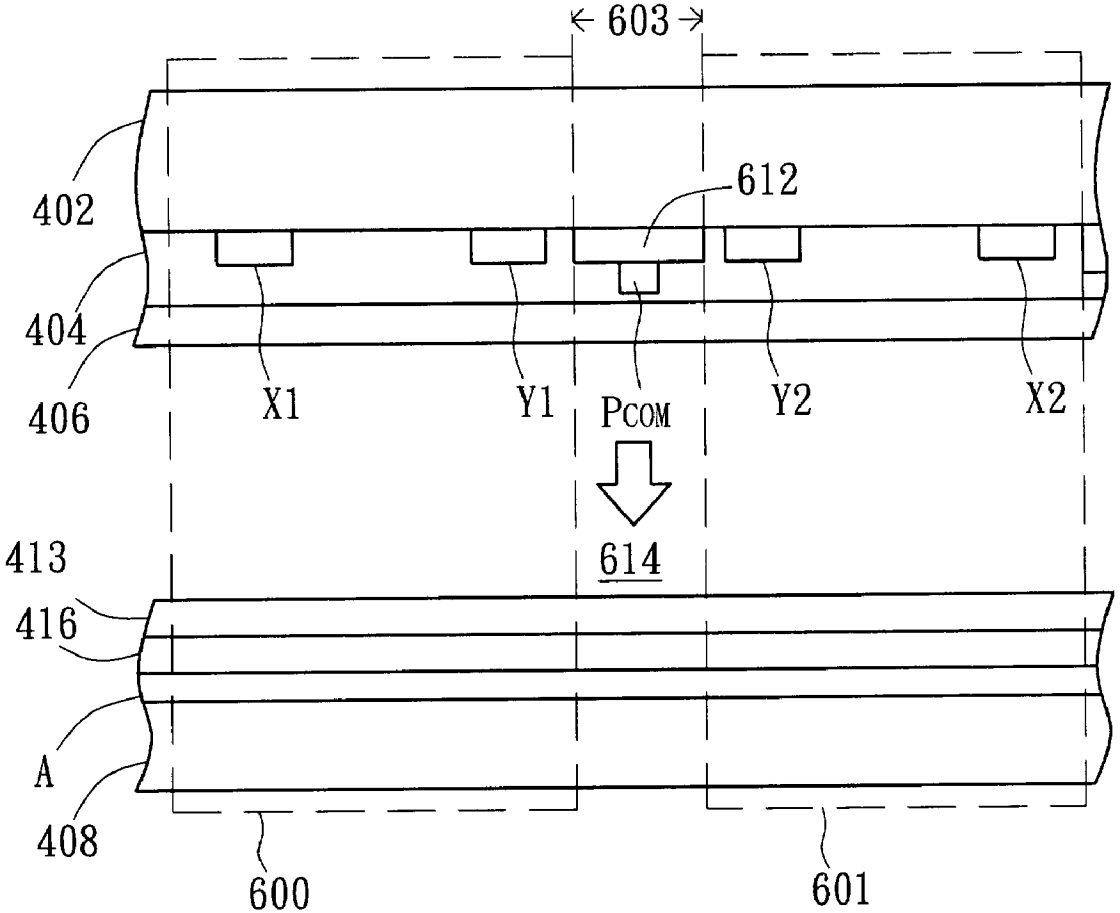
FIG. 6B illustrates the cross-sectional view of a PDP according to another embodiment of the present invention.

FIG. 6B illustrates the cross-sectional view of a plasma display panel (PDP) according to another embodiment of the present invention. Compared with FIG. 6A, FIG. 6B provides one common priming electrode $P_{COM}$ for each pair of adjacent pixel units 600, 601, wherein the common priming electrode $P_{COM}$ is positioned between the scanning electrode Y1 of the pixel unit 600 and the scanning electrode Y2 of the pixel unit 601.

Figure 7:
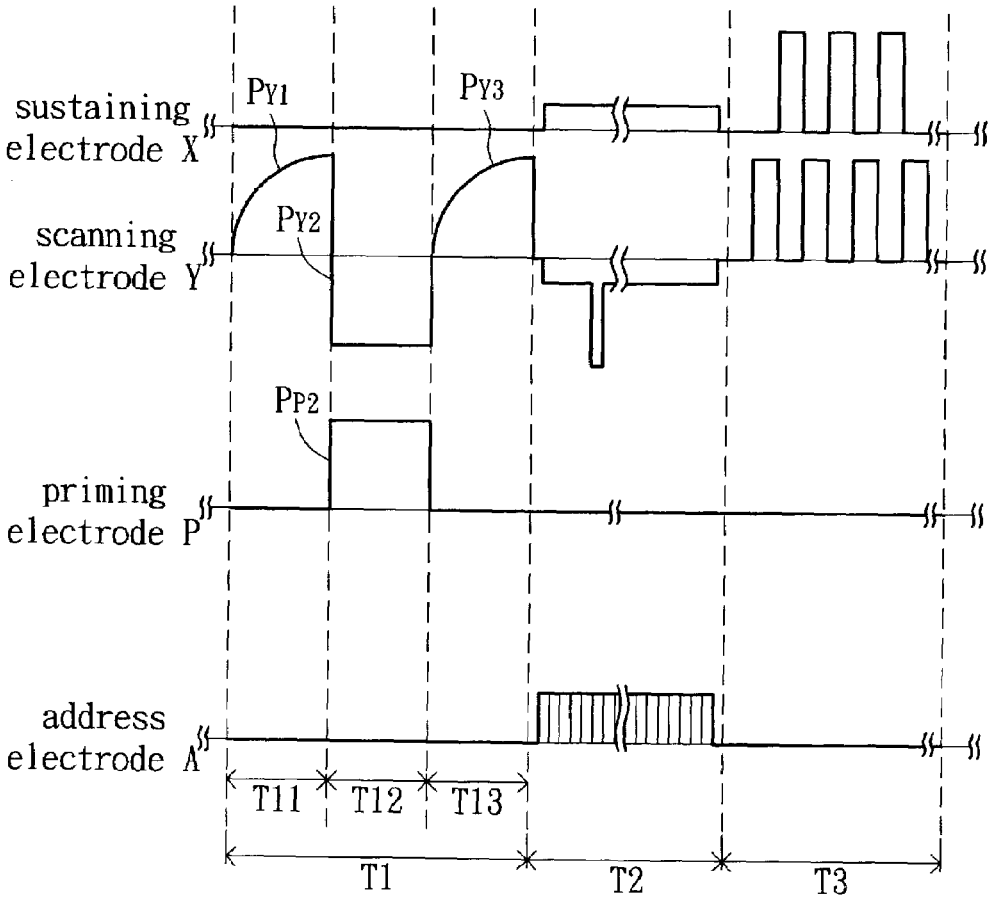
FIG. 7 illustrates the driving sequence for driving the PDP of FIG. 6A and FIG. 6B in the form of timing chart.

FIG. 7 illustrates the driving sequence for driving the PDP of FIG. 6A and FIG. 6B in the form of timing chart. During the second reset period T12, a priming pulse $P_{P2}$ with positive polarity is applied to the common priming electrode $P_{COM}$, and a priming pulse $P_{Y2}$ with negative polarity is applied to the scanning electrode Y1 of the pixel unit 600 and the scanning electrode Y2 of the pixel unit 601. In this way, the gases both in the pixel units 600 and 601 will be excited and more discharge ion will be produced.

Other than the advantages described in FIG. SA and FIG. 5B, the PDP structure of FIG. 6A and FIG. 6B further has the characteristics of low number for the priming electrodes. Therefore, the PDP can have a simpler structure, as well as the design of the driving circuit.

From the above description, the present invention improves the contrast ration, the quality, and the lifetime of the PDP by applying a priming electrode in the dark area. Moreover, the driving sequence and the driving circuit of the present invention are simplified, and the power consumption is decreased.

While the invention has been described by way of example and in terms of the preferred embodiment, it is to be understood that the invention is not limited to the disclosed embodiment. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A plasma display panel (PDP) having a first substrate and a second substrate, wherein said second substrate is opposite to said first substrate, and a discharge space is defined as the space between said first substrate and said second substrate and is filled with a discharge gas, said PDP being divided into a pixel unit and a dark area and comprising:

a sustaining electrode and a scanning electrode positioned in said pixel unit on said first substrate along a first direction;

a priming electrode positioned in said dark area on said first substrate along said first direction; and an address electrode positioned on said second substrate perpendicularly with said first direction;

wherein said priming electrode outputs a first priming pulse so as to excite said discharge gas and to produce a plurality of discharge ions;

wherein one of said sustaining electrode and said scanning electrode outputs a first erase pulse so as to remove a plurality of wall charges in said pixel unit during a first step;

said priming electrode outputs said first priming electrode so as to excite said discharge gas in said discharge space and to produce said plurality of discharge ions during a second step; and one of said sustaining electrode and said scanning electrode outputs a second erase pulse so as to remove the remaining discharge ions in said pixel unit during a third step.

2. The PDP according to claim 1, wherein when said priming electrode outputs said first priming electrode, said address electrode outputs a second priming pulse so as to excite said discharge gas in said discharge space and to produce said plurality of discharge ions during a second step.

3. The PDP according to claim 2, wherein said first priming pulse and said second priming pulse are different in polarity.

4. A plasma display panel (PDP) having a first substrate and a second substrate, wherein said second substrate is opposite to said first substrate, and a discharge space is defined as the space between said first substrate and said second substrate and is filled with a discharge gas, said PDP are divided into a first pixel unit, a second pixel unit, and a dark area, and said dark area is positioned between said first pixel unit and said second pixel unit, said PDP comprising:

a first sustaining electrode and a first scanning electrode positioned on said first substrate along a first direction;

a second sustaining electrode and a second scanning electrode positioned on said first substrate along said first direction;

a common priming electrode positioned in said dark area on said first substrate along said first direction, said common pruning electrode outputting a first priming pulse so as to excite said discharge gas and to produce a plurality of discharge ions in said first pixel unit and said second pixel unit; and an address electrode positioned on said second substrate perpendicularly with said first direction;

wherein said address electrode, said first scanning electrode, and said first sustaining electrode defines said first pixel unit;

said address electrode, said second scanning electrode, and said second sustaining electrode defines said second pixel unit.

5. The PDP according to claim 4, wherein said first scanning electrode and said second scanning electrode respectively outputs a first erase pulse so as to remove a plurality of wall charges in said first pixel unit and said second pixel unit during a first step;

said common priming electrode outputs said first priming electrode so as to excite said discharge gas in said discharge space and to produce said plurality of discharge ions in said first pixel unit and said second pixel unit during a second step; and said first scanning electrode and said second scanning electrode respectively outputs a second erase pulse so as to respectively remove the remaining discharge ions in said first pixel unit and said second pixel unit during a third step.

6. The PDP according to claim 5, wherein said common priming electrode outputs said first priming electrode and said address electrode outputs a second priming electrode so as to excite said discharge gas in said discharge space and to produce said plurality of discharge ions in said first pixel unit and said second pixel unit during said second step.

7. The PDP according to claim 4, wherein said first scanning electrode and said second scanning electrode respectively outputs a first erase pulse so as to remove a plurality of wall charges in said first pixel unit and said second pixel unit during a first step;

said common priming electrode outputs said first priming pulse and said first scanning electrode and second scanning electrode respectively outputs a third priming pulse so as to excite said discharge gas in said discharge space and to produce said plurality of discharge ions in said first pixel unit and said second pixel unit during a second step; and said first scanning electrode and said second scanning electrode respectively outputs a second erase pulse so as to respectively remove the remaining discharge ions in said first pixel unit and said second pixel unit during a third step.

8. The PDP according to claim 4, wherein said first sustaining electrode and said second sustaining electrode respectively outputs a first erase pulse so as to remove a plurality of wall charges in said first pixel unit and said second pixel unit during a first step;

said common priming electrode outputs said first priming electrode so as to excite said discharge gas in said discharge space and to produce said plurality of discharge ions in said first pixel unit and said second pixel unit during a second step; and said first scanning electrode and said second scanning electrode respectively outputs a second erase pulse so as to respectively remove the remaining discharge ions in said first pixel unit and said second pixel unit during a third step.

9. The PDP according to claim 8, wherein said common priming electrode outputs said first priming electrode and said address electrode outputs a second priming electrode so as to excite said discharge gas in said discharge space and to produce said plurality of discharge ions in said first pixel unit and said second pixel unit during said second step.

10. The PDP according to claim 4, wherein said first sustaining electrode and said second sustaining electrode respectively outputs a first erase pulse so as to remove a plurality of wall charges respectively in said first pixel unit and said second pixel unit during a first step;

said common priming electrode outputs said first priming electrode, said first scanning electrode and said second scanning electrode respectively outputs a third priming pulse so as to excite said discharge gas in said discharge space and to produce said plurality of discharge ions in said first pixel unit and said second pixel unit during a second step; and said first scanning electrode and said second scanning electrode respectively outputs a second erase pulse so as to respectively remove the remaining discharge ions in said first pixel unit and said second pixel unit during a third step.

11. A PDP comprising:

a first substrate;

a second substrate opposite to said first substrate;

a discharge space, between said first substrate and said second substrate, defining a first pixel unit, a second unit and a dark area positioned between said first pixel unit and said second pixel unit;

a discharge gas filled in said discharge space;

a first pair of electrodes including a first sustaining electrode and a first scanning electrode, positioned on said first substrate along a first direction;

a second pair of electrodes including a second sustaining electrode and a second scanning electrode, positioned on said first substrate along said first direction;

a priming electrode positioned in said dark area on said first substrate along said first direction and positioned between the first pair of electrodes and the second pair of electrodes, said priming electrode outputting a first priming pulse so as to excite said discharge gas and to produce a plurality of discharge ions in one of said first pixel unit and said second pixel unit; and an address electrode positioned on said second substrate perpendicularly with said first direction;

wherein said address electrode, said first scanning electrode, and said first sustaining electrode defines said first pixel unit; and said address electrode, said second scanning electrode, and said second sustaining electrode defines said second pixel unit.

12. The PDP according to claim 11, further comprising:

A black matrix, formed on the first substrate and positioned between the first pixel unit and the second pixel unit, wherein the priming electrode is formed under the black matrix.

13. The PDP according to claim 11, wherein the priming electrode is adjacent to the first scanning electrode and the second scanning electrode.

* * * * *